US005398841A

United States Patent [19]

Harding

[11] Patent Number: 5,398,841

[45] Date of Patent: Mar. 21, 1995

[54] STORAGE TANK FOR COMBUSTIBLE LIQUIDS

[75] Inventor: Charles W. Harding, Clarkston, Mich.

[73] Assignee: Clawson Tank Company, Clarkston, Mich.

[21] Appl. No.: 203,666

[22] Filed: Feb. 28, 1994

Related U.S. Application Data

[63] Continuation of Ser. No. 46,035, Apr. 12, 1993, abandoned, which is a continuation-in-part of Ser. No. 766,542, Sep. 26, 1991, Pat. No. 5,201,435.

[51] Int. Cl.[6] ..... B65D 90/16

[52] U.S. Cl. ..... 220/565; 220/694; 220/86.1; 220/500; 220/415

[58] Field of Search ..... 220/500, 729, 694, 565, 220/86.1, 415, 571

[56] References Cited

U.S. PATENT DOCUMENTS

| | | | |
|---|---|---|---|
| 1,520,230 | 12/1924 | Flath . | |
| 1,970,940 | 8/1934 | Laube . | |
| 2,256,673 | 9/1941 | Hansen | 220/565 |
| 2,260,356 | 10/1941 | White | 220/565 |
| 2,673,010 | 3/1954 | Barrow | 220/86.1 |
| 2,777,295 | 1/1957 | Bliss et al. . | |
| 2,876,925 | 3/1959 | Wall et al. | 220/565 |
| 3,125,388 | 3/1964 | Costantini et al. . | |
| 3,338,010 | 8/1967 | Waugh . | |
| 3,352,443 | 11/1967 | Sattelberg et al. . | |
| 3,411,654 | 11/1968 | Grabner et al. | 220/565 |
| 3,473,689 | 10/1969 | Hutter . | |
| 3,930,590 | 1/1976 | Ebbrell . | |
| 4,425,743 | 1/1984 | Bartur . | |
| 4,519,415 | 5/1985 | Carn . | |
| 4,714,170 | 12/1987 | Scott . | |
| 4,960,222 | 10/1990 | Fields, III . | |
| 4,976,912 | 12/1990 | Madle et al. . | |
| 5,033,637 | 7/1991 | Webb | 220/565 |
| 5,033,638 | 7/1991 | Cruver et al. . | |
| 5,154,312 | 10/1992 | Robbins | 220/86.1 |
| 5,201,435 | 3/1993 | Harding et al. . | |

FOREIGN PATENT DOCUMENTS

| | | | |
|---|---|---|---|
| 41637 | 8/1937 | Netherlands | 220/565 |

*Primary Examiner*—Joseph Man-Fu Moy
*Attorney, Agent, or Firm*—Barnes, Kisselle, Raisch, Choate, Whittemore & Hulbert

[57] ABSTRACT

A peninsula which extends outwardly from a wall of a container for receiving and supporting a fluid-dispensing pump thereon for dispensing liquid in the container. The peninsula has a pump mounting platform surface that is elevated above ground level and set back from an outer edge of the peninsula for preventing another object from colliding with the pump. An upraised curb, which includes a pair of outwardly extending walls and an interconnecting rear wall, borders the sides and rear of the platform surface to shield and support the pump. The peninsula has a sump basin in the platform surface that is positioned underneath the pump for collecting leaking fluid from the pump and associated piping and containing the fluid in an environmentally safe manner.

2 Claims, 1 Drawing Sheet

STORAGE TANK FOR COMBUSTIBLE LIQUIDS

Reference to Related Application

This is a continuation of applications Ser. No. 08/046,035, filed on Apr. 12, 1993, now abandoned, which is a continuation-in-part of application Ser. No. 07/766,542, filed on Sep. 26, 1991, now U.S. Patent No. 5,201,435.

FIELD OF THE INVENTION

This invention relates to an above ground storage container for liquids and more particularly to a peninsula which extends outwardly from a sidewall of the container for mounting a fluid-dispensing pump thereon.

BACKGROUND OF THE INVENTION

A wide variety of island arrangements have been used for supporting a pump that dispenses fluid from a tank. One such arrangement commonly used to support one or more pumps that dispense combustible liquids is in the form of a concrete island that is separated a distance from the tank. Typically, the island has a platform surface for mounting a pump thereon and may contain a piping access opening in the platform surface. Piping, which runs underground or aboveground overhead of the pump, allows fluid to be transferred from the tank to the pump.

In one such commercially successful island design heretofore utilized by applicant, the island consists of a generally rectangular concrete pad that is cast in place at the installation site a distance away from a combustible fluid container. The pad has an upraised platform surface for mounting a pump thereon and a lip around the periphery of the pad for creating an open leakage containment basin around the pump. To protect the pump from damage by errant vehicles, an upright concrete-filled pipe standard is cast in the pad on either side of the platform surface. Fluid from the tank is transferred by underground piping which passes through an access opening in the platform surface to connect to the pump.

Although applicant's prior art island construction described above has enjoyed substantial commercial acceptance and success, improvements nonetheless remain desirable. For example, the concrete pad of the island is separately constructed a distance from the tank increasing construction and installation costs, while piping for the installation is laid underground increasing the chance for an environmentally contaminating leak. Constructing the pad as a separate component at the installation site requires more time and expense to install than if the pad were precast as part of the container construction and installed with the container. Since the island and tank are separated by a distance, any shifting, settling or abrupt movement of either component can cause the underground piping to rupture possibly releasing combustible fluid into the environment. Furthermore, placing the piping in potentially corrosive underground surroundings can affect the structural integrity of the piping over time which can result in leakage or unanticipated failure.

SUMMARY OF THE INVENTION

In accordance with this invention, a peninsula extends outwardly from a container for receiving and supporting a fluid-dispensing pump thereon. In the specific embodiment about to be described, the container has an inner tank for containing combustible fluid and an outer protective concrete vault for containing liquid leakage from the inner tank. The peninsula is integrally cast as part of the vault and extends outwardly from the vault for positioning the pump in close proximity to the tank. The peninsula has a base with a pump mounting platform surface on top, a curb bordering the rear and sides of the platform surface for protecting the pump, and a sump basin for containing liquid leaked from the pump and its associated piping. Further in accordance with the specific embodiment, formed within the peninsula and an adjacent sidewall of the vault are a pair of spaced apart vertically oriented piping sleeves and an electrical conduit. A second electrical conduit for housing an electrical line which supplies power to the pump is also integrally formed within the peninsula.

To prevent an object exterior of the peninsula from colliding with the pump, the platform surface preferably is elevated above ground level and permits the pump to be mounted offset from the front edge of the base. The curb has a pair of outwardly extending spaced apart protective walls which bracket the pump and an interconnecting rear wall behind the pump for protecting the pump while preventing the pump from displacing or twisting if impacted by another body. The sump basin has an opening in the platform surface which is positioned underneath the pump and possesses a recessed portion for providing additional leak containment volume. Both sleeves open into the basin for providing easy access to connect piping to the pump and for channeling any fluid leaked within the sleeves by the piping downwardly into the sump basin. The power conduit has an opening in the exterior of the base at one end and an opening in the basin at the opposite end that is elevated for preventing liquid from draining from the sump while shielding the elements from filling the sump and reducing its containment volume.

One object of this invention is to provide a container/peninsula arrangement having some or all of the foregoing features.

Another object of this invention is to provide an improved pump mounting arrangement which can receive and support a fluid-dispensing pump in a stable manner.

Still another object of this invention is to provide a peninsula for mounting a pump thereon in a safe, secure and protected fashion.

A feature of this invention is that the peninsula and sidewall of the vault are precast for producing a strong, durable and simple to manufacture container and peninsula assembly of one piece concrete construction that is quick, easy and inexpensive to install.

Another feature of this invention is that the length of pump piping required is reduced because the pump is mounted on the platform surface in close proximity to the inner tank further reducing material costs and simplifying installation.

A still further feature of this invention is that the pump piping is completely protected within a container and peninsula of stable one-piece construction greatly reducing exposure to corrosive surroundings while preventing pipe rupture due to shifting or movement of the container and peninsula.

Another object of of this invention is to provide a peninsula which has a sump basin for containing fluid leaked from the pump and its associated piping to prevent environmental contamination.

These and other objects and features of the invention will become more apparent as the following description proceeds, especially when considered with the accompanying drawings.

DETAILED DESCRIPTION OF THE INVENTION

Figure 1:
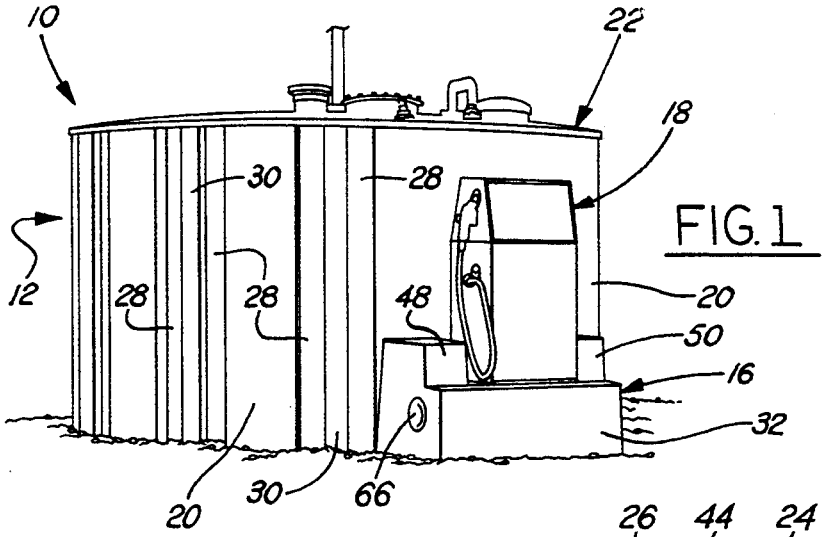
FIG. 1 is a perspective view of a container illustrating a pump-supporting peninsula of this invention extending outwardly from the container.

Referring now more particularly to the drawings, FIG. 1 illustrates a container 10 having an outer concrete vault 12 and an inner steel tank 14 with a peninsula 16 of this invention extending outwardly from vault 12 for receiving and supporting a liquid-dispensing pump 18 thereon. Vault 12 includes a cylindrical wall 20 of concrete mounted on a concrete base (not shown) and a conical metal roof 22 overlying wall 20. Tank 14 is constructed of a cylindrical steel wall 24 which is attached along its top rim to metal roof 22 defining a fluid-tight compartment for containing combustible liquids such as gasoline or diesel fuel for motor vehicles.

Steel wall 24 is spaced inwardly from vault wall 20 for providing an air envelope 26 between walls 20 and 24 to contain any leakage from tank 14. To ventilate containment envelope 26, the exterior surface of vault wall 20 has a plurality of circumferentially spaced recessed vertical channels 28 and outwardly projecting vertical flutes 30 between each pair of channels 28. Channels 28 communicate at their upper ends with envelope 26 through spaces between the top of vault wall 20 and the overlying conical metal roof 22. Channels 28 direct air flow exterior of vault 12 upwardly between roof 22 and top of vault wall 20 through those spaces into envelope 26.

Figure 3:
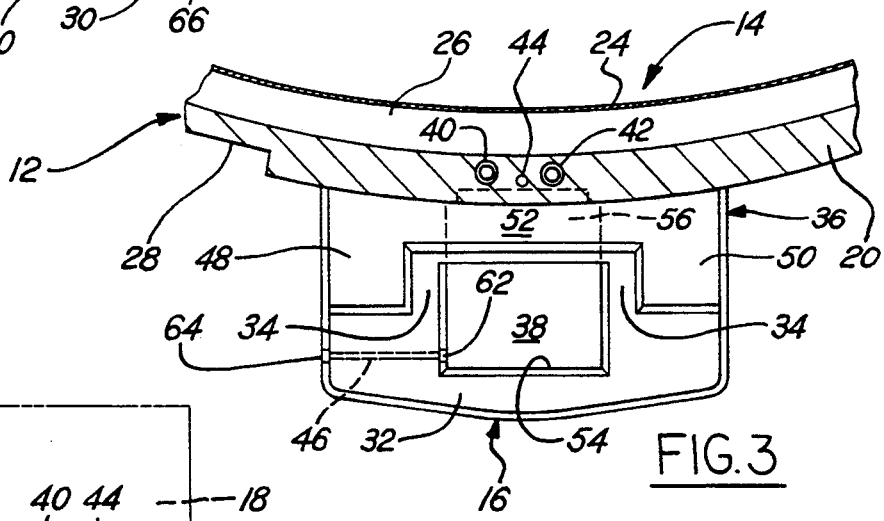
FIG. 3 is a fragmentary view taken along line 3—3 of FIG. 2 illustrating the container in section and the peninsula.
Figure 2:
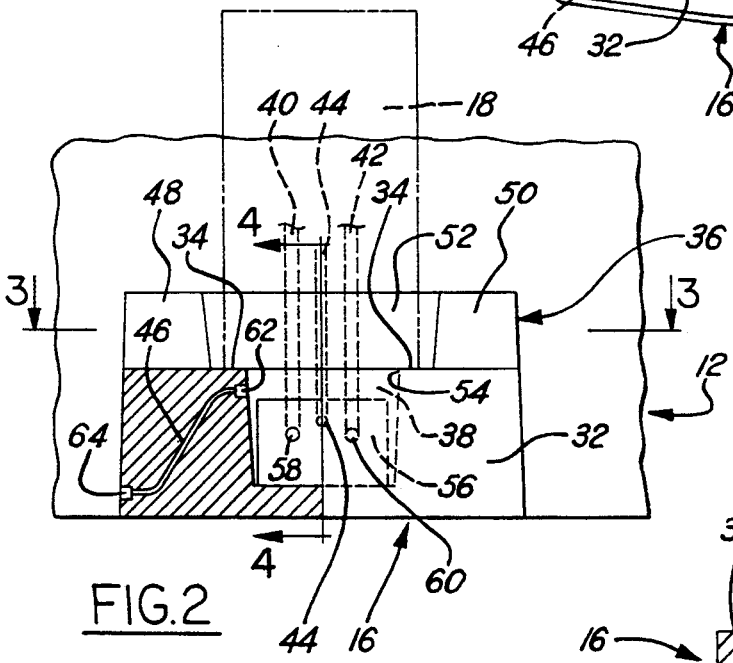
FIG. 2 is a fragmentary front elevational view of the container and peninsula with parts in section to illustrate a sump basin.
Figure 4:
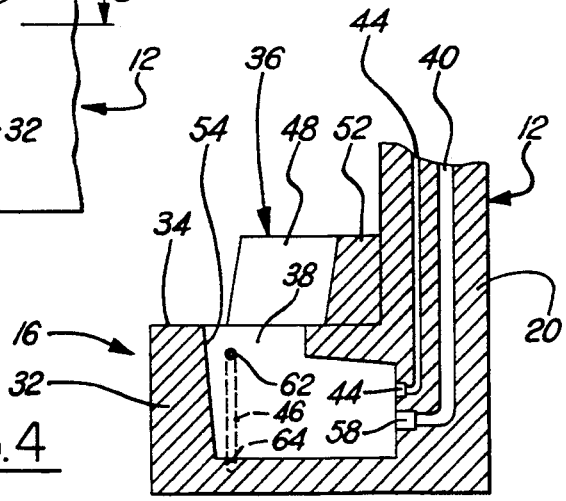
FIG. 4 is a fragmentary sectional view taken along line 4—4 of FIG. 2.

As is shown more clearly in FIGS. 2–4, peninsula 16 has a base 32 with a pump mounting platform surface 34 on top, a curb 36 generally bordering the rear and sides of platform surface 34 for protecting pump 18, and a sump basin 38 for containing liquid leakage from pump 18 and associated piping (not shown). Formed within vault wall 20 are a pair of spaced apart vertical piping sleeves 40, 42 which provide functional fluid passages between inner tank 14 and pump 18, and a conduit 44 for housing electrical wiring. Formed within peninsula 16 is a second conduit 46 also for housing electrical wiring.

Referring more particularly to FIGS. 2 and 3, platform surface 34 of peninsula 16 is of generally flat, horizontal, rectangular and preferably smooth construction for receiving pump 18 mounted thereon in a stable manner. Base 32 is of sufficient thickness to elevate platform surface 34 above ground level for protecting pump 18 from impact with an object exterior of peninsula 16, yet permitting easy access to pump 18 for use. Preferably, platform surface 34 is positioned at least above bumper height to protect pump 18 from impact with a vehicle pulling alongside of pump 18. To prevent a moving object above platform surface 34 from contacting pump 18, platform surface 34 extends rearwardly sufficiently so that pump 18 may be mounted rearwardly offset from the front edge of base 32.

To further prevent collision with an object exterior of pump 18, curb 36 has a pair of outwardly extending spaced apart walls 48, 50 which bracket the sides of pump 18. Interconnecting walls 48 and 50 is a rear wall 52 which abuts against the rear of pump 18 spacing pump 18 away from sidewall 20 of vault 12. Should a moving body contact pump 18, walls 48, 50 and 52 of curb 36 support and restrain pump 18 from displacing or twisting to prevent rupture of pump piping and piping connections.

Sump basin 38 has a generally rectangular opening 54 that is generally centrally located in platform surface 34 underneath pump 18 to capture leakage from within pump 18. To provide additional containment volume for holding leaked fluid, basin 38 has a recessed portion 56 of generally rectangular cross section that extends inwardly to adjacent vault sidewall 20. Preferably, sump opening 54 is smaller than the horizontal cross sectional contour of pump 18 so that the bottom edges of the pump sidewalls completely encompass opening 54 for preventing the elements, such as rain or snow, from filling basin 38 reducing its containment volume.

As is illustrated in FIGS. 3 & 4, piping sleeves 40, 42 are integrally formed within vault sidewall 20 and peninsula 16 for simplifying piping installation and providing for delivery of fluid from tank 14 to pump 18 as well as drainage ductwork surrounding the piping for conveying any fluid leaked from the piping safely into sump 38. Sleeves 40 and 42 each have an opening 58, 60 in recess 56 of sump 38 and in the top of wall 20 (not shown) permitting piping to be fed downwardly into sleeves 40, 42 and attached to pump 18. When installed, the piping is fully contained within sleeves 40, 42 and sump basin 38 to support and protect the piping. Preferably, sleeve 40 houses a fluid suction line (not shown) which runs from tank 14 to pump 18 for permitting fluid to be drawn from tank 14 and dispensed by pump 18. To capture and contain fluid vaporized during pumping, sleeve 42 preferably houses a vapor recovery line (not shown) that is connected to pump 18.

Referring again to FIG. 2, conduit 46 is integrally formed in base 32 of peninsula 16 for housing an electrical line which supplies power to pump 18. To provide a passage completely through base 32, conduit 46 has an opening 62 in sump basin 38 at one end and an opening 64 in the exterior of base 32 at the opposite end. Opening 62 in sump basin 38 is positioned adjacent the top rim of basin 38 for preventing fluid received in sump 38 from draining through conduit 46, out opening 64, and into the environment. Opening 64 is positioned below elevated opening 62 for preventing moisture outside peninsula 16 from entering sump basin 38 and reducing its containment volume. Preferably, opening 64 is covered by a circular plate 66 (FIG. 1) to further shield conduit 46 and prevent access to wiring within conduit 46.

Base 32, platform surface 34, curb walls 48, 50 and 52, and sump cavity 38 of peninsula 16 are all integrally formed as one piece of precast reinforced concrete. To facilitate removal of forms after casting, the various surfaces of peninsula 16 are draft-angled as is shown in FIGS. 2–4. As is illustrated in FIG. 4, peninsula 16 and vault wall 20 are preferably fabricated together as one piece of precast reinforced concrete for ease and speed of manufacture and installation. Preferably, peninsula 16 and vault wall 20 are constructed of Siliceous Aggregate Concrete to produce a vault construction having superior fire endurance characteristics.

While the present invention has been disclosed in connection with the preferred embodiments thereof, it should be understood that there may be other embodiments which fall within the spirit and scope of the invention and that the invention is susceptible to modification, variation and change without departing from the proper scope or fair meaning of the following claims.

What is claimed is:

1. An above ground storage container for volatile liquids which comprises:

(a) an inner steel tank having a side wall and adapted to contain volatile inflammable liquids, (b) an outer concrete container having a base and a side wall surrounding said inner tank, the side wall of said concrete container being separated from the side wall of said inner tank to provide an air envelope around the inner tank, (c) an enclosing top wall sealingly carried by the side wall of said inner tank to contain volatile inflammable liquids within said inner tank, said enclosing top wall overlying the side wall of said concrete container with space provided therebetween to allow air flow into said air envelope from exterior of said concrete container and from said air envelope to the exterior and for protecting said envelope from the elements, and (d) a concrete peninsula extending laterally outwardly from said side wall of said concrete container serving as an extension of said concrete container, (e) said concrete peninsula and side wall of said concrete container being integrally fabricated of one piece of concrete, (f) said concrete peninsula having a base for supporting said peninsula above ground and having a platform surface above said base of said peninsula for supporting a liquid-dispensing pump.

2. An above ground storage container as defined in claim 1, and further including a liquid-dispensing pump mounted on said platform surface of said peninsula, wherein said platform surface has an outer edge remote from said side wall of said concrete container, said pump is set back from said outer edge toward said side wall of said concrete container to protect said pump from damage due to accidental contact with a moving object, and said concrete peninsula has laterally spaced apart, upraised walls extending upwardly from said platform surface along opposite sides of said pump to further protect said pump from damage due to accidental contact with a moving object.

* * * * *